US005547519A

United States Patent [19]

Murphy

[11] Patent Number: 5,547,519

[45] Date of Patent: Aug. 20, 1996

[54] MAGNESIA COATING AND PROCESS FOR PRODUCING GRAIN ORIENTED ELECTRICAL STEEL FOR PUNCHING QUALITY

[75] Inventor: Robin A. Murphy, Middletown, Ohio

[73] Assignee: Armco Inc., Middletown, Ohio

[21] Appl. No.: 463,807

[22] Filed: Jun. 5, 1995

Related U.S. Application Data

[62] Division of Ser. No. 395,552, Feb. 28, 1995.

[51] Int. Cl.[6] ..... H01F 1/04

[52] U.S. Cl. ..... 148/113; 148/110

[58] Field of Search ..... 148/113, 111, 148/110

[56] References Cited

U.S. PATENT DOCUMENTS

| | | | |
|---|---|---|---|
| 4,168,189 | 9/1979 | Haselkorn et al. | 148/113 |
| 4,179,315 | 12/1979 | Miller | 148/113 |
| 4,207,123 | 6/1980 | Reynolds et al. | 148/113 |
| 4,344,802 | 8/1982 | Haselkorn | 148/113 |
| 4,443,425 | 4/1984 | Sopp et al. | 148/113 |
| 4,775,340 | 10/1988 | Tanaka et al. | 148/113 |

*Primary Examiner*—John Sheehan

*Attorney, Agent, or Firm*—L. A. Fillnow; R. J. Bunyard; R. H. Johnson

[57] ABSTRACT

The present invention provides an annealing separator composition for coating grain oriented electrical steel prior to the final high temperature anneal for secondary grain growth. The magnesia based coating contains at least 20% silica on a water free basis. The large silica additions limit the interface between the coating and the base metal and results in a thick glass which is easily removed. The magnesia coating develops excellent magnetic properties and does not require the normal strong acid cleaning or special abrasive means to remove the glass film which forms. The bare electrical steel, which may be coated to enhance the punching properties, has improved the die life because the hard glass film has been substantially removed.

11 Claims, 3 Drawing Sheets

* COIL 1 ▲ COIL 2 ○ COIL 3

COATING A: Conventional Punching Quality (PQ) MgO
COATING B: Conventional PQ MgO + 2.0% SO4
COATING C: Conventional PQ MgO + 2.0% SO4 + 5.0% CaCl2
COATING D: Inactive MgO + 2.0% SO4 + 35% SiO2

COATING A: CONVENTIONAL PUNCHING QUALITY(PQ) MgO (1000X)

COATING B: CONVENTIONAL PQ MgO + 2.0% $SO_4$(1000X)

"TOP" SURFACE
COATING C: CONVENTINOAL PQ MgO+ 2.0% $SO_4$ + 5.0% $CaCl_2$ (1000X)

"BOTTOM" SURFACE
COATING C: CONVENTINOAL PQ MgO+ 2.0% $SO_4$ + 5.0% $CaCl_2$ (1000X)

COATING D: INACTIVE MgO + 2.0% $SO_4$ +35% $SiO_2$(1000X)

| | | |
|---|---|---|
| * COIL 1 | ▲ COIL 2 | ○ COIL 3 |

COATING A: Conventional Punching Quality (PQ) MgO
COATING B: Conventional PQ MgO + 2.0% SO4
COATING C: Conventional PQ MgO + 2.0% SO4 + 5.0% CaCl2
COATING D: Inactive MgO + 2.0% SO4 + 35% SiO2

| | | |
|---|---|---|
| * COIL 1 | ▲ COIL 2 | ○ COIL 3 |

COATING A: Conventional Punching Quality (PQ) MgO
COATING B: Conventional PQ MgO + 2.0% SO4
COATING C: Conventional PQ MgO + 2.0% SO4 + 5.0% CaCl2
COATING D: Inactive MgO + 2.0% SO4 + 35% SiO2

MAGNESIA COATING AND PROCESS FOR PRODUCING GRAIN ORIENTED ELECTRICAL STEEL FOR PUNCHING QUALITY

This application is a division of Patent application Ser. No. 08/395,552, filed Feb. 28, 1995 and which is hereby incorporated by reference.

BACKGROUND OF THE INVENTION

The present invention relates to the processing of grain oriented electrical steel and particularly to a process wherein the glass film formed by reacting an annealing separator with the electrical steel during the final high temperature anneal may be easily removed.

Electrical steel is normally subjected to a decarburizing anneal in order to lower the carbon present in the steel to prevent magnetic aging. An accepted maximum carbon level is about 0.004%. The wet decarburizing atmosphere reduces the iron and oxidizes the carbon and silicon. The carbon is removed in the form of a gaseous oxide and the silicon present in the base metal is oxidized to silica which remains on the surface and as inclusions beneath the surface. The steel is then coated with a magnesia annealing separator and subjected to a high temperature final anneal in which the secondary grain growth is developed. The magnesia reacts with the silica and produces a tightly adherent glass film of magnesium silicate, also known as forsteritc ($Mg_2SiO_4$), which provides interlaminar resistivity and prevents the laps of the steel coil from sticking together. It is also very important that the annealing separator does not interfere with purification of the steel during the high temperature anneal.

The presence of the glassy film is not always advantageous for subsequent processing. This hard and abrasive oxide is very hard on punching dies used to stamp out the laminations for producing transformer cores. It is also very difficult to remove the glass by pickling in strong acids or by using abrasive means.

The production of punching quality electrical steel has normally limited the thickness of the glass film formed and subsequently removed the glass by pickling in strong acids. In the past, a coating of 0.5 mm thickness was considered sufficiently thin to be removable.

Previous attempts to limit or reduce the glass film formation, however, have been found to have an adverse impact on the secondary grain growth stability and have resulted in poor magnetic quality (typically incomplete grain growth and/or poor texture development).

U.S. Pat. No. 3,930,906 (Toshio Irie et al.—assigned to Kawasaki Steel Corporation) found that good magnesia adhesion was developed when the iron oxide on the surface during decarbufization oxidized the silicon in the base metal to $SiO_2$. When the iron oxide was reduced with hydrogen, the film had low adhesion. The patent discusses the role of atmosphere, penetration between the laps of the coil and heating conditions on the formation of the $MgO\text{-}SiO_2$ glass film.

One could use a separator such as alumina which does not interfuse with the silica on the surface, but it is very difficult to desulfurize the steel with this coating on the surface. The adherence doesn't allow for good handling and processing through the annealing stages. Japanese Published Unexamined Patent Application No. 53(1978)-22113 uses an annealing separator consisting of fine alumina powder blended with hydrated silica to suppress the formation of a glass film. The resulting oxide film is very thin.

Prior magnesias were normally active magnesia which had citric acid activities below 200 seconds and typically below 100 seconds. Inactive magnesia was not used because the slurry was not stable and the magnesia particles tended to settle to the bottom of the tank. Calcining the magnesia above 1300° C. reduced its reactivity and suppressed the formation of forsteritc.

There have been very few patents which have attempted to use inactive magnesia to coat grain oriented silicon steel. U.S. Pat. No. 4,344,802 (Michael H. Haselkom—assigned to Armco Inc.) worked with magnesia which had a citric acid activity greater than 200 seconds. Phosphates were added to the magnesia to keep the particles from settling which created a slurry with a viscosity that could be applied to the steel and produce an acceptable coating weight. The resulting slurry had good adherence and reacted with the steel surface to form a glass film Japanese Published Unexamined Patent Application No. 59(1984)- 96278 discloses an annealing separator which consists of $Al_2O_3$ which has a low reactivity with the $SiO_2$ in the oxide film formed during decarburization. Part of the annealing separator is MgO which was calcined at more than 1300° C. to reduce its reactivity. This separator suppresses the formation of forsterite.

U.S. Pat. No. 3,375,144 (David W. Taylor—assigned to Armco Steel Corporation) mixed alkali metals, such as the sulfides and hydroxides of sodium and potassium, with the magnesia to enable the easy removal of the surface by scrubbing and short-time pickling. It was believed that the addition removed sub-surface siliceous particles.

U.S. Pat. No. 3,378,581 (Dale M. Kohler—assigned to Armco Steel Corporation) added calcium oxide to magnesia as the annealing separator to improve desulfurization. The surfaces were to be free of overlying adherent films of annealing separators and glassy derivatives therefrom. Thin films were desired and the formation of a glass film was largely avoided by the use of a nonhydrating magnesia. A thick glass film and one which will be oxidizing to the iron will be avoided by using calcium oxide.

U.S. Pat. No. 4,875,947 (Hisanobu Nakayama et al—assigned to Nippon Steel Corporation) prevents the formation of a glass film by adding one or more salts of alkali metals such as Li, Na, K and alkaline-earth metals such as Ca, Ba, Mg and Sr to the magnesia. The salt decomposes the $SiO_2$ in the oxide film and prevents the reaction which forms the glass. To maintain the good punching characteristics, an inorganic coating is applied to prevent oxidation during a thermal flattening or stress relief annealing and then an organic coating is applied which improves the punching property.

A decarburizing treatment will thus oxidize the surface of silicon steel and produce at and near the surface a distinct layer of silica. U.S. Pat. No. 3,201,293 (Victor W. Curtis—assigned to Armco Steel Corporation) found that heat treatment in a decarburizing atmosphere will give a satisfactory die life only up to about 1700° F. which is not high enough to develop the optimum magnetic properties. A band or line of oxide at the original interface between the base metal and the skin forms during decarburization. The oxidation of the silicon below the band in the final high temperature anneal raises the band to about the mid thickness of the final surface.

The discussion above clearly illustrates that there is a need for an annealing separator coating for electrical steel which forms a glass which is easily removed. Prior attempts to limit the glass formation have not optimized the magnetic quality or have resulted in glass which is not easily and completely removable. Prior magnesia coating systems have not been directed to the control of the interface between the coating and the base metal in order to provide a coating which is easily removed.

SUMMARY OF THE INVENTION

The present invention is directed to a magnesia annealing separator for electrical steel which forms a glass film during the final high temperature anneal. The glass film is easily removed after the completion of secondary grain growth. After the coatings are removed, the steels are particularly suited for punching quality applications which require surfaces that won't damage the dies used to punch or stamp out the laminations. The magnesia coating of the present invention is not limited to punching quality applications. Any application of an oriented electrical steel where a glass film is not required, would benefit from the present invention.

Magnesia and silica are the principal ingredients of the separator coating. Any magnesia may be used with the present coating and the use of inactive magnesia has some attractive advantages. A water slurry of magnesium oxide is typically mixed with silica in an amount of at least 20% by weight on a waters free basis. The silica is preferably colloidal, but may be any particle size. The silica does not limit the surface reactions but the glass film does not adhere to the base metal. A very smooth interface between the glass film and the base metal is believed to contribute to the ease of delamination of the glass film. Since the magnesia coating provides good surface reactions, the level of a magnetic properties is also improved.

It is an object of the present invention to provide a grain oriented electrical steel for punching quality which has an annealing separator coating which is easily removed after the final high temperature anneal.

It is also an object of the present invention to provide a removable as magnesia coating which provides excellent magnetic properties by controlling the surface interactions between the base metal and the coating.

It is a feature of the present invention that the addition of silica in large amounts to the magnesia for grain oriented electrical steel will produce a glass film which is easily removed.

It is also a feature of the present invention that the magnesia coating process will be improved by the large additions of silica which help to control viscosity of the magnesia slurry and reduce the amount of settling of the magnesia particles.

It is a still further feature of the present invention that the magnesia of the invention may be further modified with a sulfate addition to further improve the magnetic properties of electrical steel produced using a single cold rolling stage.

It is an advantage of the present invention that the amount of die wear during punching of the electrical steel laminations will be significantly reduced due to the improved surface on the electrical steel.

It is a still further advantage of the present invention that the addition of silica with the magnesia allows the use of inactive magnesia particles and avoids settling problems.

It is also an advantage of the present invention that the pickling step to remove the glass film may be eliminated when high levels of silica are added to the magnesia.

Another advantage of the present invention is that the use of inactive magnesia does not require refrigeration during processing in order to control hydration of the magnesia.

The above objects, features and advantages, as well as others, will be apparent from the following description of the preferred invention.

DESCRIPTION OF THE PREFERRED EMBODIMENT

Figure 1A:
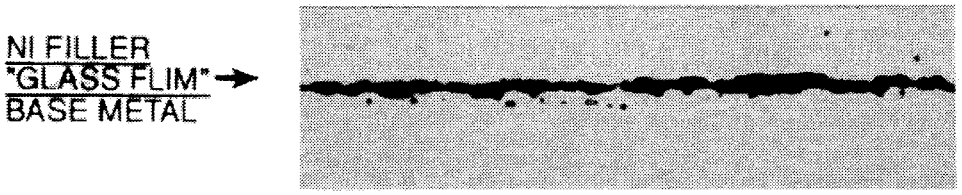
FIG. 1*a* is a photomicrograph at 1000x of the interface between the glass and the base metal when a conventional active magnesia is used.
Figure 1B:
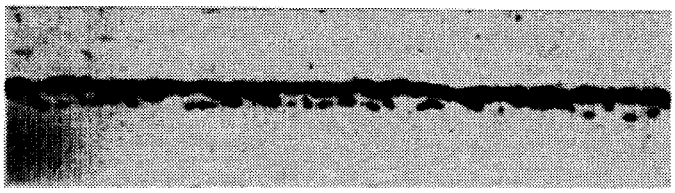
FIG. 1*b* is a photomicrograph at 1000x of the interface between the glass and the base metal when a conventional active magnesia with 2 parts by weight $SO_4$ is used.
Figure 1C:
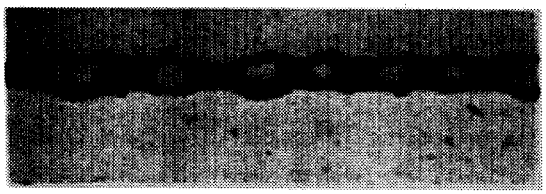
FIG. 1*c* is a photomicrograph at 1000x of the top surface interface between the glass and the base metal when a conventional active magnesia with 2 parts by weight $SO_4$ and 5 parts by weight $CaCl_2$ is used.
Figure 1D:
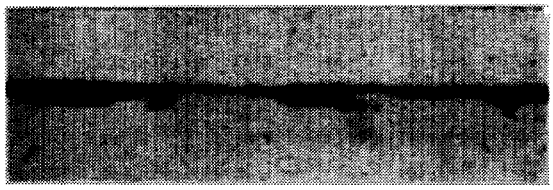
FIG. 1*d* is a photomicrograph at 1000x of the bottom surface interface between the glass and the base metal when a conventional active magnesia with 2 parts by weight $SO_4$ and 5 parts by weight $CaCl_2$ is used.
Figure 1E:
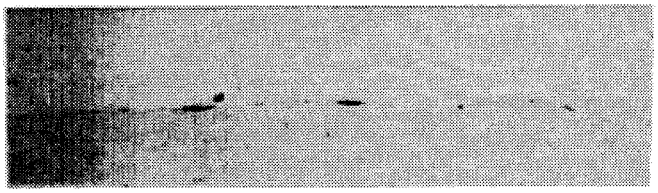
FIG. 1*e* is a photomicrograph at 1000x of the interface between the glass and the base metal when an inactive magnesia of the present invention with 2 parts by weight $SO_4$ and 35 parts by weight $SiO_2$ is used.

In the production of grain oriented electrical steel, strip is processed using conventional melting, casting, hot rolling, optional annealing, and cold rolling in one or more stages with intermediate annealing for multiple stages of cold rolling. The strip is then typically decarburized to remove carbon which prevents magnetic aging. The decarburizing atmosphere is wet hydrogen which forms $SiO_2$ and iron oxide on the surfaces of the strip. An annealing separator, typically magnesia is then applied on the resulting oxide layers and wound into a coil and subjected to a final annealing. The anneal is typically within a temperature range of 1100°–1300° C. in a hydrogen atmosphere that forms an insulating glass and produces secondary grain growth with the desired orientation.

The composition of the steel and the various processing steps from melting through decarburization are conventional and do not form a limitation on the present invention. The present invention provides a magnesia annealing separator coating for electrical steels after decarburization which is easily removed after the secondary grain growth anneal. The coating is not related to a secondary coating for insulation or a coating to improve punchability. The coatings of the invention are used to separate the laps of the coil during the film high temperature anneal in which secondary grain growth is obtained.

The surfaces of the silicon steel after decarburization will have oxide layers composed of silica and iron oxide. It has previously been accepted that thin oxide layers were the easiest to remove by pickling and that thicker layers formed glass films which adversely affected the magnetic properties. The lamination factor is lowered as the oxide increases (the cross section % of the base metal decreases in proportion to the thickness of the oxide). The grain nuclei on the surface of the cold rolled steel from which the secondary recrystallized grains of the desired orientation are developed were believed to have been lost by the oxidation.

During production, there will be variations in the dew point and atmosphere concentrations in the decarburizing furnace. This will contribute to variations in the thickness of the oxide films formed on the surfaces of the strip. Depending on the history of the complete process, there are also variations in oxidation across the width of the strip and throughout the length of the coil. Any variations in the past contributed to the nonuniform removal of the glass film. Up to the present invention, there has not been a consistent method for uniform removal of the glass film with acceptable magnetic quality.

The present addition of silica to the magnesia may be made in many different ways. The source of silicon may be various water soluble or water dispersible silicon compounds. Exemplary of such compounds are silica, and particularly colloidal silica, silicic acid, and natural silicon products such as kaolins, micas, feldspar, and the like. Excellent results have been obtained when using colloidal silica as the source of silicon in the present composition. The list of silica sources is not a limitation, but is merely exemplary of various compounds which may be used.

While not wishing to be bound by theory, it is believed that the addition of silica to the magnesia in the present invention alters the normal oxidation and reduction reactions occurring during the secondary recrystallization anneal following decarburization. The iron oxide formed during decarburization previously oxidized the silicon in base metal to $SiO_2$ at the final annealing temperatures by the following reaction (1):

$$2\ FeO+Si=2Fe+SiO_2 \quad (1)$$

This reaction provided a film with good adhesion. However, during the final anneal, the tightly wrapped coils did not allow the hydrogen in the atmosphere to penetrate because the pressure between the coil laps was higher than the pressure of the atmosphere. This is attributed to the heat expansion from the heating and the steam dissociated from the chemically bound and physically absorbed water contained in the as-dried magnesia coating. The hydrogen thus has a very difficult time in penetrating into the coil laps. The iron oxide on the decarburized surface is then not madfly reduced by the reaction (2):

$$FeO+H_2=Fe+H_2O \quad (2)$$

Typically, $SiO_2$ has a favorable reaction direction at about 800° C. and higher. The resistance to the $H_2$ penetration remains until about 1000° C. at which temperature the steam no longer evolves from the annealing separator. The MgO in the separator combines with the $SiO_2$ and forms the glass film ($Mg_2SiO_4$). Once the glass forms, the amount of hydrogen penetration increases, but reaction 1 to the right has been completed and equation 2 does not occur.

With the present invention, it is believed that the large quantities of $SiO_2$ in the magnesia are available to form the glass film. The glass film may consist of $Mg_2SiO_4$ but could include various Fe and Mg silicates and other reaction components. The Fe and Mg readily substitute in the solid solution of the glass coating. This permits the formation of a thick glass which does not depend on surface reactions with the $SiO_2$ formed during decarburization. The glass permits hydrogen penetration which reduces the FeO based on reaction 2. The FeO reduction substantially lowers the adhesion of the glass. It appears that the penetration of the hydrogen at an earlier stage in the final anneal alters the direction of the reactions which favors the reduction of the FeO and the strength of the interface.

Silica is added in an amount of 15–65 parts by weight, preferably 20–55 parts by weight and more preferably 25–45 parts by weight. The amount of magnesia will be 100 parts by weight minus the parts by weight of silica.

Silica has a dramatic influence on the control of the viscosity of the magnesia slurry. The silica addition has allowed the use of inactive magnesia and avoided the settling problem which normally occurs. Inactive magnesia has a larger particle size which tends to settle out of the slurry. The optimum amount of silica to be added is dependent upon specific magnesia characteristics and the viscosity of the slurry.

The present invention may provide the full range of coating weights desired and is typically adjusted to provide a dry coating weight of up to 10 grams/$m^2$/side with a normal weight being about 3–4 grams/$m^2$/side. Silica tends to lower the firing temperature and provides a more glossy film. Increasing the silica levels also increases the tension imparting characteristic of the glass which serves to facilitate its delamination from the base metal. High silica levels serve to provide thicker glass films which further promote the delamination process. A thicker glass film augments delamination more readily due to the large difference in thermal expansion at the interface with the base metal.

The present invention provides a glass which is easily removed regardless of the magnesia particle size and activity. However, optimum benefits are provided when an inactive magnesia is used. Inactive magnesia provides improved hydralion control and typically is far less expensive than active magnesia.

The annealing separator composition may also contain a blend of active and inactive magnesia. The inclusion of some active magnesia may be found to provide better control of the secondary grain growth and the sulfur relationship to the MnS inhibitor.

Sulfur is preferably added to the magnesia to prevent premature desulfurization during the high temperature anneal. There are many acceptable forms of sulfur-bearing compounds which may be used. While not limiting, acceptable sulfur-bearing compounds include ferrous sulfate, sodium sulfate, magnesium sulfate and the like. Magnesium sulfate (Epsom Salt, $MgSO_4 \cdot 7H_2O$) has been found to be particulary advantageous for reasons of availability, cost and its nontoxic nature. Up to 5 parts by weight sulfates may be added and 1–2 parts by weight is preferred. Sulfur additions in the magnesia coating improve the stability of the secondary grain growth.

Other additions, such as calcium phosphate, titania and boron may be added singularly or in combination in the magnesia for hydralion control, sulfur removal and/or increasing the thickness of the glass film. It is important to the invention that the additions do not significantly alter the smoothness of the interface between the base metal and the coating.

It is important to the understanding of the present coating system that one understands that a glass film is desirable in terms of developing the best possible magnetic quality. Formation of a glass prevents premature loss of sulfur which is needed for the desired oriented grain structure.

The decarburizing and final annealing conditions are not a limitation of the present coating system. Any temperatures, heating rates and soak temperatures used in present practices may be used in combination with the annealing separator coating of the present invention.

There are numerous coatings which may be applied to further improve the punching characteristics of the steel. These are typically organic coatings which are applied over the bare steel or magnesia coated steel after processing has been completed. Patents such as U.S. Pat. Nos. 3,948,786, 3,793,073 and 3,909,313 improve the life of the punching dies and reduce welding problems.

Any method may be used for applying the annealing separator to the grain oriented electrical steel strip. Typically, the aqueous coating slurry is applied to the steel strip using metering rolls. Nonaqueous based slurries may also be applied. The coating may also be applied in a dry form such as by electrostatic painting.

The addition of silica within the claimed ranges to a magnesia which may be active or inactive has been shown to provide an improved interface which is very smooth. While not wishing to be bound by theory, it is believed that the large amounts of silica in the coating change the driving direction of the reaction. In the past, the magnesia present on the surface reacted with the silica which formed on the surface as a result of the oxidation of the silicon in the base metal foraged during decarburization. Providing large amounts of silica in the magnesia allows the magnesia to react in the coating rather than at the base metal interface. It is believed that the inward diffusion reactions in the past caused the rough interface and made the prior glass more adherent to the base metal.

In order to develop a better understanding of the present invention and the method in which it may be practiced, the following specific examples are given. It will be appreciated, however, that these examples are merely exemplary of the preferred embodiment of the present invention and are not to be taken as a limitation thereof. In these examples the magnesia slurries were prepared by mixing the magnesia with water. The silica was then added in various proportions such that the total amount of magnesia and silica was 100 parts by weight. With most of these compositions, other additives were included. These prepared slurries were applied to as-decarburized steel blanks with the use of grooved rubber metering rolls. The coatings were then dried at 250°–300° C. for about 60 seconds. As-dried coating weights were controlled in the range of 3–4 grams/m$^2$/side.

Samples prepared in this manner were then stacked and wrapped in an iron-silicon foil. The wrapped stacks were then subjected to standard high-temperature texture anneals, which included using a soak temperature of 1200° C. for 15 hours. The box anneal atmosphere was controlled by passing hydrogen through the furnace.

EXAMPLE 1

TABLE I.a defines the coating compositions used in this experiment The important characterisitcs of the various magnesia types used are explained in TABLE I.b. The as-decarburized steel samples used in this study had four different base metal compositions. With regard to the most important base metal chemistry components, silicon ranged from 3.09% to 3.20%, carbon from 0.029% to 0.037%, manganese from 0.055% to 0.060%, sulfur from 0.020% to 0.024%, and chromium from 0.06% to 0.25%. The balance consisted essentially of iron, with the inclusion of unavoidable impurities.

TABLE I.a

| COATING CODE | COATING COMPOSITIONS MgO Type | Parts MgO | Parts SiO2 | Parts SO4 | SiO2 Particle Size (nm) |
|---|---|---|---|---|---|
| A | 1 | 65 | 35 | 1.5 | 20 |
| B | 1 | 65 | 35 | 1.0 | 20 |
| C | 1 | 65 | 35 | 0.5 | 20 |
| D | 1 | 50 | 50 | 1.0 | 20 |
| E | 1 & 2 | 25 & 25 | 50 | 1.0 | 20 |
| F | 2 | 65 | 35 | 1.0 | 7 |
| G | 2 | 50 | 50 | 1.0 | 7 |
| H | 3 | 65 | 35 | 1.0 | 20 |
| I | 3 | 50 | 50 | 1.0 | 20 |
| J | 2 & 3 | 25 & 25 | 50 | 1.0 | 20 |
| K* | 1 | 65 | 35 | 1.0 | 20 |
| L* | 4 | 65 | 35 | 1.0 | 20 |
| M* | 5 | 65 | 35 | 1.0 | 20 |

*Coatings K, L, & M include 2 parts Monocalcium Phosphate Monohydrate

TABLE I.b

| MgO Type | MgO-Types Citric Acid Activity (sec) | Cl (ppm) | Median Particle Size (Microns) |
|---|---|---|---|
| 1 | 62 | 100 | 1.0 |
| 2 | >10,000 | <20 | 10.8 |
| 3 | 153 | 70 | 1.2 |
| 4 | 72 | 280 | 1.1 |
| 5 | 145 | 2200 | 1.4 |

After the high temperature texture anneal, the samples were individually wiped clean to remove any of the excess surface reaction products. The ease with which this material could be removed, as well as the appearance of the steel surfaces after cleaning, were recorded. This surface cleanliness and appearance information is given in TABLE I.c.

The cleaned samples were restacked and subjected to a stress relief anneal at 830° C. for four hours. The samples were then tested for their magnetic properties, which are given here as averages in TABLE I.c.

TABLE I.c

| COATING CODE | MAGNETIC QUALITY and GLASS FILM REMOVAL DATA H-10 PERMEABILITY | P15;60 (W/lb) | P17;60 (W/lb) | "Glassless" Rating* |
|---|---|---|---|---|
| A | 1849 | 0.620 | 0.842 | 5 |
| B | 1847 | 0.626 | 0.848 | 4 |
| C | 1847 | 0.623 | 0.844 | 4 |
| D | 1852 | 0.617 | 0.825 | 2 |
| E | 1847 | 0.620 | 0.831 | 3 |
| F | 1890 | 0.603 | 0.808 | 1 |
| G | 1843 | 0.624 | 0.843 | 3 |
| H | 1849 | 0.629 | 0.843 | 3 |
| I | 1851 | 0.629 | 0.836 | 2 |
| J | 1848 | 0.647 | 0.859 | 3 |
| K | 1847 | 0.614 | 0.837 | 5 |
| L | 1844 | 0.624 | 0.847 | 6 |
| M | 1848 | 0.639 | 0.856 | 6 |

Averages for 4 Coils, 3 Tests/Coil/Coating
Average Gauge = 14 mils (0.35mm)
"Glassless" Ratings;
1 = Complete glass removal on all coils with cloth wiping
2 = Complete glass removal on all coils with light abrasive pad scrubbing
3 = Complete glass removal on all coils with heavy abrasive pad scrubbing TABLE I.c-continued

| COATING CODE | MAGNETIC QUALITY and GLASS FILM REMOVAL DATA H-10 PERMEABILITY | P15;60 (W/lb) | P17;60 (W/lb) | "Glassless" Rating* |
|---|---|---|---|---|

4 = Incomplete glass removal on some coils with heavy abrasive pad scrubbing
5 = Incomplete glass removal on all coils with heavy abrasive pad scrubbing
6 = No glass removal on all coils with heavy abrasive pad scrubbing TABLE I.c indicates that all of the compositions provided good and acceptable magnetic quality. It should be noted, however, that some of the coatings did provide superior magnetic quality relative to other coatings. For example, by increasing the silica addition level from 35 parts to 50 parts with the active magneisa "Type 1" (coatings "B" and "D" ), it can be seen that the higher silica level provided superior magnetic quality (lower core losses and higher H-10 permeabilties). Conversely, increasing the silica level from 35 parts to 50 parts with the inactive magnesia "Type 2" (coatings "F" and "G") resulted in a degradation in magnetic quality. This demonstrates how the selection of the proper silica addition level may be dependent on the inherent characteristics of the magnesia type in use.

With regard to other magnetic quality effects, it was observed that the sulfate addition level did not play a major role (coatings "A", "B", and "C"). Mixing active and inactive magnesias did not significantly affect magnetic quality in one instance (compare coatings "D" and "E"), yet in another instance the combination of active and inactive magnesia did cause a significant drop in magnetic quality with regard to the average core loss (compare coatings "I" and "J"). Again, with regard to optimum magnetic properties, the appropriate silica addition level can be seen to be dependent on the type(s) of magnesias selected.

The glass film removal ratings ("1" through "6") given in TABLE I.c can be placed into two major catagories. Those coatings that were given ratings from "1" to "4" are coatings of the invention. While the description given for rating "4" may seem to indicate an unacceptable level of performance, it should be noted that the four different coils used in this experiment were observed to behave differently (with regard to ease of coating removal) for several of the coatings. More specifically, two of the coils demonstrated that complete glass film removal was obtained with the use of coatings "B" and "C". It is believed that variations in the thickness of the as-decarburized oxide layer present on the four different coils played a major role in this apparently inconsistent performance, which was especially apparent for coatings "B" and "C".

As noted above with regard to the coatings' effects on magnetic quality performance, the preferred silica addition level varied with changes in the type(s) of magnesia(s) used. Using the same comparisons for coatings "B" vs. "D" (active magnesia Type-1) and coatings "F" vs. "G" (with the inactive magnesia), increasing the silica addition level can be seen to either improve or as degrade the ease of glass film removal. It is interesting that these two optimum glass film performance coatings ("D" and especially "F") were also the best coatings with regard to magnetic quality performance.

The poor performance for coatings "A", "K", "L", and "M" can be explained through several means. For coating "A", it was apparent that the high sulfate level (1.5 parts added) did increase the adherence of the glass film coating. Similarly, the inclusion of 2 parts of monocalcium phosphate degraded the glass film removal performance of magnesia Type-1 (coating "K"). The extremely poor performance ratings ("6") for coatings "L" and "M" can also be attributed, in part, to the monocalcium phosphate addition, but it is strongly believed that the high inherent chloride levels in these two magnesias (Type-4 and Type-5, TABLE I.b) played a major role in producing a strongly adherent glass film coating.

EXAMPLE 2

This experiment was performed to show the advantages of the optimum coating indentified in EXAMPLE 1 relative to conventional magnesia coatings used to produce punching quality grades of oriented electrical steel. Included in this experiment is a coating taught by U.S. Pat. No. 4,875,947, where high addition levels of calcium chloride are used to provide a glass-free product. The specific coating compositions are given in TABLE II.a. The base metal composition of the three samples of as-decarburized steel fall within the ranges given under EXAMPLE 1.

TABLE II.a

| COATING CODE | COATING COMPOSITIONS MgO Type | Parts MgO | Parts SiO2 | Parts SO4 | Parts CaCl2 |
|---|---|---|---|---|---|
| A | 1 | 100 | 0 | 0.0 | 0 |
| B | 1 | 100 | 0 | 2.0 | 0 |
| C | 1 | 100 | 0 | 2.0 | 5 |
| D | 2 | 65 | 35 | 2.0 | 0 |

MgO-Type 1 = Conventional Punching Quality MgO:
CAA = 145 seconds
Cl = 2200 ppm
Particle Size = 1.4 microns
MgO-Type 2 = Inactive MgO:
CAA > 10,000 seconds
Cl < 20 ppm
Particle Size = 10.8 microns FIGS. 1.*a*–1.*e* show the glass film optical photomicrographs that resulted from the use of the four coatings included in the study. FIGS. 1.*a* and 1.*b* show that with a conventional punching quality type of magnesia, a thick and continuous glass film is formed on the surface of the steel. The degree of interfacial roughness seen in these pictures indicates a type of glass film that requires a strong acid to remove the bulk of the coating. These coatings are particularly hard to pickle due to the subsurface extensions of the glass film into the base metal. The inclusion of 2 pans of sulfates can be seen to increase the thickness and interfacial roughness of the coating by comparing FIGS. 1.*a* (coating "A", TABLE II.a) and 1.*b* (coating "B").

FIGS. 1.*c* and 1.*d* show that the chloride coating (coating "C") was not only unsuccessful with regard to providing a glass-free surface, but that two distinctly different types of glass films were obtained on opposite sides of the steel blanks. The "iron-globular" type of glass film shown in FIG. 1.*c* (so named due to the "globs" of iron embedded in the glass) is known to be a consequence of the high chloride addition level. It is expected that even higher levels of chloride would be required to enable this type of glass film formation mechanism to eventually result in a glass-free surface. It is not known why the "Top" and "Bottom" surfaces had such different glass film characteristics.

FIG. 1.*e* shows the advantages of the present invention. For all three coils included in this experiment, 100% glass-free surfaces were obtained. This is verified by the lack of any glass film in FIG. 1.*e*. While it is difficult to even observe the "interface" in this figure, it can be seen that this magnesia coating produced a very smooth surface/interface.

Figure 2:
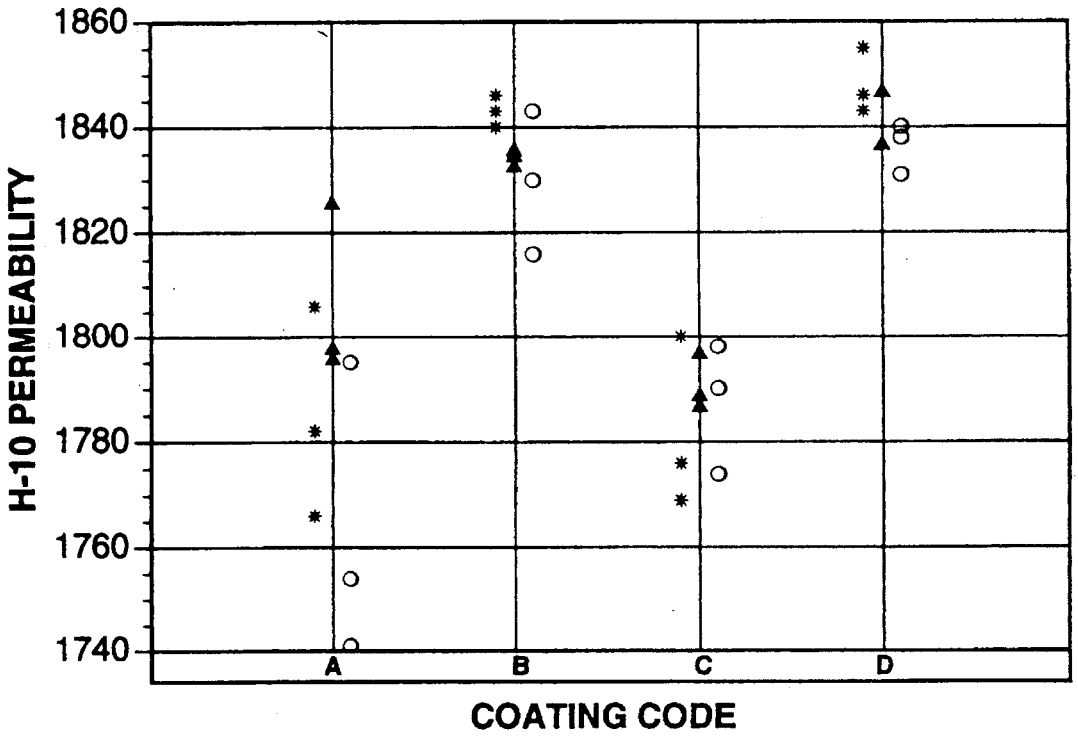
FIG. 2 is a permeability comparison with four different magnesia compositions on three steel samples.
Figure 3:
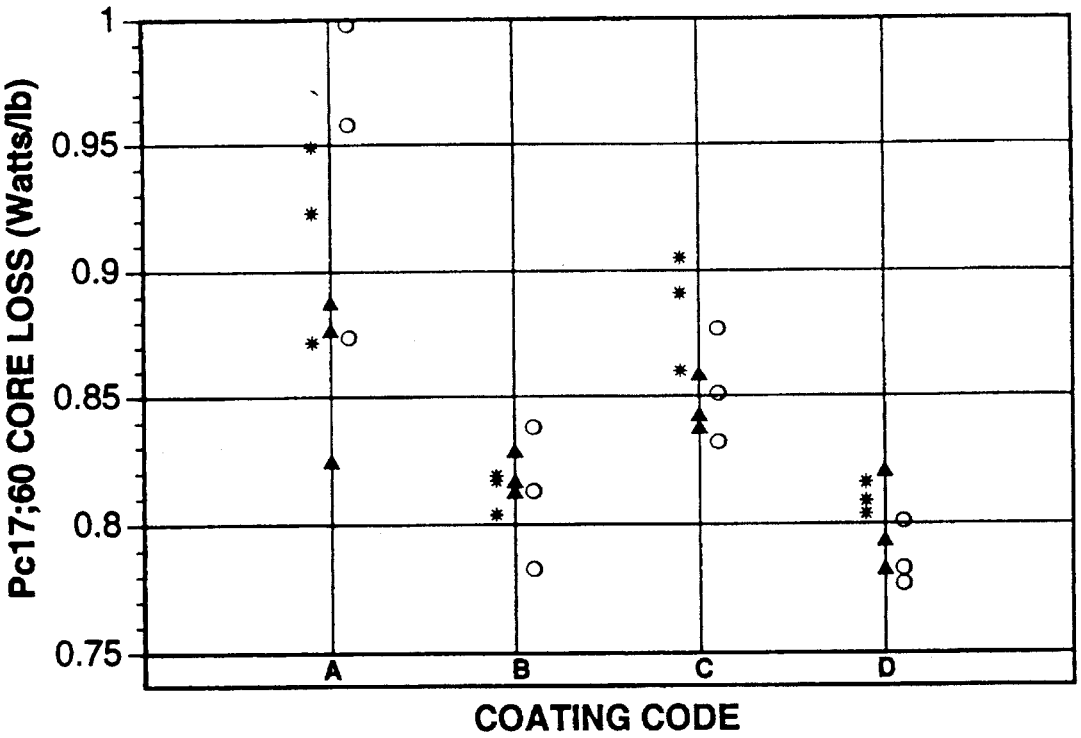
FIG. 3 is a core loss comparison with four different magnesia compositions on three steel samples.

The magnetic quality results from this experiment are given in TABLE II.b. The H-10 permeability results from all of the blanks tested in this study are graphically presented in FIG. 2. A similar distribution of the 17 kilogauss core losses (P17;60) are given in FIG. 3. The permeability and core loss data show that with the conventional "PQ" MgO, sulfate additions are required to obtain acceptable magnetic quality (compare coatings "A" and "B"). Even with the use of the 2 parts surfate addition, these figures show that when high chloride addition levels were used in an effort to provide a glass-free surface (coating "C"), very poor magnetic quality resulted. If higher chloride levels could be used to provide a glass-free surface (as suggested above), even further degradations in magnetic quality would be predicted.

TABLE II.b

MAGNETIC QUALITY DATA

| | COATING A | | | COATING B | | |
|---|---|---|---|---|---|---|
| COIL # | H-10 PERM | Pc15 (W/lb) | Pc17 (W/lb) | H-10 PERM | Pc15 (W/lb) | Pc17 (W/lb) |
| 1 | 1785 | 0.624 | 0.915 | 1843 | 0.579 | 0.813 |
| 2 | 1807 | 0.596 | 0.863 | 1835 | 0.579 | 0.820 |
| 3 | 1763 | 0.635 | 0.943 | 1830 | 0.572 | 0.811 |
| Averages | 1785 | 0.618 | 0.907 | 1836 | 0.577 | 0.815 |

| | COATING C | | | COATING D | | |
|---|---|---|---|---|---|---|
| COIL # | H-10 PERM | Pc15 (W/lb) | Pc17 (W/lb) | H-10 PERM | Pc15 (W/lb) | Pc17 (W/lb) |
| 1 | 1782 | 0.613 | 0.885 | 1848 | 0.590 | 0.810 |
| 2 | 1791 | 0.588 | 0.847 | 1844 | 0.580 | 0.799 |
| 3 | 1787 | 0.592 | 0.853 | 1836 | 0.569 | 0.787 |
| Averages | 1787 | 0.597 | 0.862 | 1843 | 0.579 | 0.799 |

The figures and TABLE II.b show that optimum magnetic quality results were obtained with a coating of the present invention (coating "D"). In addition to providing excellent magnetic properties, this coating produced a surface completely free of a glass film coating that did not require acid pickling for punching quality applications.

The invention as described herein above in the context of a preferred embodiment is not to be taken as limited to all of the provided details thereof, since modifications and variations thereof may be made without departing from the spirit and scope of the invention. It should also be understood that any preferred or more preferred range for one element may be used with the broad ranges for the other elements for the compositions of the invention.

What is claimed is:

1. A method for producing regular grain oriented electrical steel strip having a permeability measured at 796 A/m of at least 1780 comprising the steps of:

a) decarburizing said strip to provide a maximum carbon level of 0.005% and silica surface layers on said strip;

b) applying an annealing separator coating containing magnesia and at least 15 parts by weight silica on a water free basis to said strip;

c) subjecting said decarburized strip with said annealing separator coating to a high temperature anneal whereby said magnesia reacts with said silica in said coating to form a glass film on said decarburized strip when heated within the range of 1100°–1300° C. in a hydrogen atmosphere, said glass film is characterized by a smooth interface between said glass film and said electrical steel; and d) removing said glass film.

2. The method for producing regular grain oriented electrical steel strip as claimed in claim 1 wherein said silica is colloidal silica.

3. The method of claim 1 wherein said magnesia is inactive magnesia.

4. A method of lowering the adhesion of a glass film during a final anneal of regular grain oriented electrical steel, said method comprising the steps of:

a) providing a decarburizing anneal to said electrical steel to lower said electrical steel's carbon content to a level below 0.005%;

b) applying an annealing separator coating to said decarburized electrical steel, said annealing separator coating containing magnesia and 15–65 parts by weight silica on a water free basis;

c) annealing said decarburized electrical steel to react said silica and said magnesia to form said glass film with a lower adhesion to said steel by increasing hydrogen penetration during said anneal and increasing said glass film's tension imparting characteristic; and d) removing said glass film.

5. The method of claim 4 wherein said glass film is formed at 1100°–1300° C. in said anneal.

6. A method of altering oxidation and reduction reactions of an annealing separator coating during secondary recrystallization of regular grain oriented electrical steel to facilitate delamination of said annealing separator coating from said steel, said method comprising the steps of:

a) decarburizing said steel to provide a carbon content of less than 0.005% and to form iron oxide and silica on said steel;

b) applying a magnesia annealing separator coating containing 15–65 parts by weight silica on a water free basis;

c) heating said steel to provide secondary recrystallization annealing, said annealing forming a glass film by reacting said separator coating and said annealing separator coating silica which permits hydrogen penetration during said annealing to alter said oxidation and reduction reactions to favor reduction of said iron oxide and facilitate said glass film delamination from said steel; and d) removing said glass film.

7. The method of claim 6 wherein said silica in said annealing separator coating is added in an amount of 20–55 parts by weight.

8. The method of claim 6 wherein said silica in said annealing separator coating is added in an amount of 25–45 parts by weight.

9. The method of claim 6 wherein said magnesia is inactive magnesia.

10. The method of claim 6 wherein said magnesia is a blend of active and inactive magnesia.

11. The method of claim 6 wherein up to 5 parts by weight sulfur is added to said magnesia.

* * * * *